US007570178B1

(12) United States Patent
Whalen et al.

(10) Patent No.: US 7,570,178 B1
(45) Date of Patent: Aug. 4, 2009

(54) TRAFFIC DISPLAY

(75) Inventors: Donald J. Whalen, Cedar Rapids, IA (US); Sethu R. Rathinam, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 326 days.

(21) Appl. No.: 11/724,664

(22) Filed: Mar. 15, 2007

(51) Int. Cl.
*G08G 5/04* (2006.01)

(52) U.S. Cl. ..... 340/961; 340/945; 340/970; 701/121; 342/38

(58) Field of Classification Search ..... 340/945, 340/961, 970; 701/121; 342/38
See application file for complete search history.

(56) References Cited

U.S. PATENT DOCUMENTS 6,348,877 B1 * 2/2002 Berstis et al. ..... 340/980
7,382,285 B2 * 6/2008 Horvath et al. ..... 340/961
2005/0007270 A1 * 1/2005 Block ..... 340/945

* cited by examiner

*Primary Examiner*—Davetta W Goins
*Assistant Examiner*—Samuel J Walk
(74) *Attorney, Agent, or Firm*—Daniel M. Barbieri

(57) ABSTRACT

The present invention is directed to a traffic display for an aircraft, which includes a vertical traffic indicator. The vertical traffic indicator includes flight levels, depicted utilizing differing visual patterns to represent the current flight level as well as available and unavailable flight levels for transit. The vertical traffic indicator includes aircraft indicators positioned in relation to flight levels to indicate attitude. The aircraft indicators may also include status indicators indicating separation standards, vertical trend, intent, or whether an aircraft is a reference aircraft for an ITP. The traffic display provides clear and intuitive means of understanding the flying environment related to the performance of the ITP, increasing situational awareness and simplifying the ITP. The traffic display is specifically advantageous for performance of an ITP, but may be integrated with displays including terrain, weather, flight plan waypoints, or TCAS (Traffic Collision Avoidance System) traffic.

21 Claims, 9 Drawing Sheets

TRAFFIC DISPLAY

FIELD OF THE INVENTION

The present invention relates generally to guidance instruments and more particularly to a traffic display.

BACKGROUND OF THE INVENTION

Oceanic regions have little or no radio voice coverage and radar surveillance to assist in air traffic control. Because of these communication difficulties and navigational inaccuracies, separation standards utilized by oceanic air traffic control for clearances must be very large. Aircraft may utilize a system called Automatic Dependent Surveillance-Broadcast (ADS-B) to broadcast information over a dedicated radio data link. The information may include current position, current attitude, category of the aircraft, airspeed, identification, and whether the aircraft is changing course (turning, climbing, or descending). Aircraft which utilize ADS-B may also have a display rendering positions of surrounding aircraft in the vicinity, which may be utilized to provide an Airborne Separation Assurance System (ASAS). The utilization of ASAS mitigates limitations in oceanic regions by allowing the aircraft to assume responsibility for monitoring separations between air traffic control-designated aircraft.

One application of ASAS is an In-Trail procedure (ITP). ITP allows an aircraft to transit through a flight level occupied by another aircraft at a much lower separation than the normal standard. This allows an aircraft to achieve a flight level where normal separation standards can be maintained by transiting through the intermediate flight level where it is not possible to maintain the normal separation standard. This enables more frequent flight level changes to optimal altitudes for better flight and fuel efficiency. Additionally, this enables improved safety by avoiding turbulent flight levels. Typically, the need to climb or descend is determined and potentially blocking aircraft at intermediate levels are checked for. If a potentially blocking aircraft is present at an intermediate level, compliance with ITP conditions is checked (referencing the potentially blocking aircraft). If ITP conditions are satisfied, clearance is then granted for the ITP. The aircraft then re-checks compliance and performs the ITP.

However, existing traffic displays do not visually present necessary information concerning vertical and horizontal traffic separation for an ITP. Thus, the pilot of the aircraft does not have clear and intuitive means of understanding the flying environment related to the performance of the ITP, decreasing situational awareness and complicating the ITP. Consequently, it would be desirable to provide a traffic display to visualize the vertical and horizontal traffic separation for an ITP.

SUMMARY OF THE INVENTION

Accordingly, the present invention is directed to a traffic display for visualizing the vertical and horizontal traffic separation for an ITP (In-Trail Procedure).

The present invention is a traffic display for an aircraft which includes a vertical traffic indicator. The vertical traffic indicator includes flight levels. The flight levels represent various altitudes. The flight levels are depicted as patterned lines or other visual metaphors. Differing colors and line patterns are utilized to represent the current flight level of the aircraft, available flight levels for transit, and unavailable flight levels for transit. The vertical traffic indicator also includes aircraft indicators, representing the aircraft and other aircraft within an area of the aircraft, positioned in relation to flight levels to indicate the attitude of the aircraft. The aircraft indicators are depicted as triangles, dots, or other visual metaphors. The aircraft indicators may also include status indicators indicating separation standards for an aircraft, vertical trend or intent for an aircraft, or whether an aircraft is a reference aircraft for an ITP. The status indicators may be depicted as boxes, text, arrowed lines, or other visual metaphors. The traffic display may also include a closing speed indicator presenting information concerning the closing speed between the aircraft and another aircraft in the area of the aircraft which has been selected as a reference aircraft for an ITP. The closing speed indicator may be depicted as a meter or other visual metaphor, such as text.

The present invention provides a traffic display for visualizing the horizontal and vertical traffic separation for an ITP. The aircraft and other aircraft in the area of the aircraft are depicted, along with their respective flight levels. The flight levels which are available or are not available (for the aircraft to transit to) are immediately visually apparent from the traffic display. Thus, the pilot of the aircraft has clear and intuitive means of understanding the flying environment related to the performance of the ITP, increasing situational awareness and simplifying the ITP. The present invention is specifically advantageous for performance of an ITP, but may be integrated with displays including terrain, weather, flight plan waypoints, or TCAS (Traffic Collision Avoidance System) traffic without departing from the scope of the present invention.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to exemplary embodiments of the invention, examples of which are illustrated in the accompanying drawings.

Figure 1:
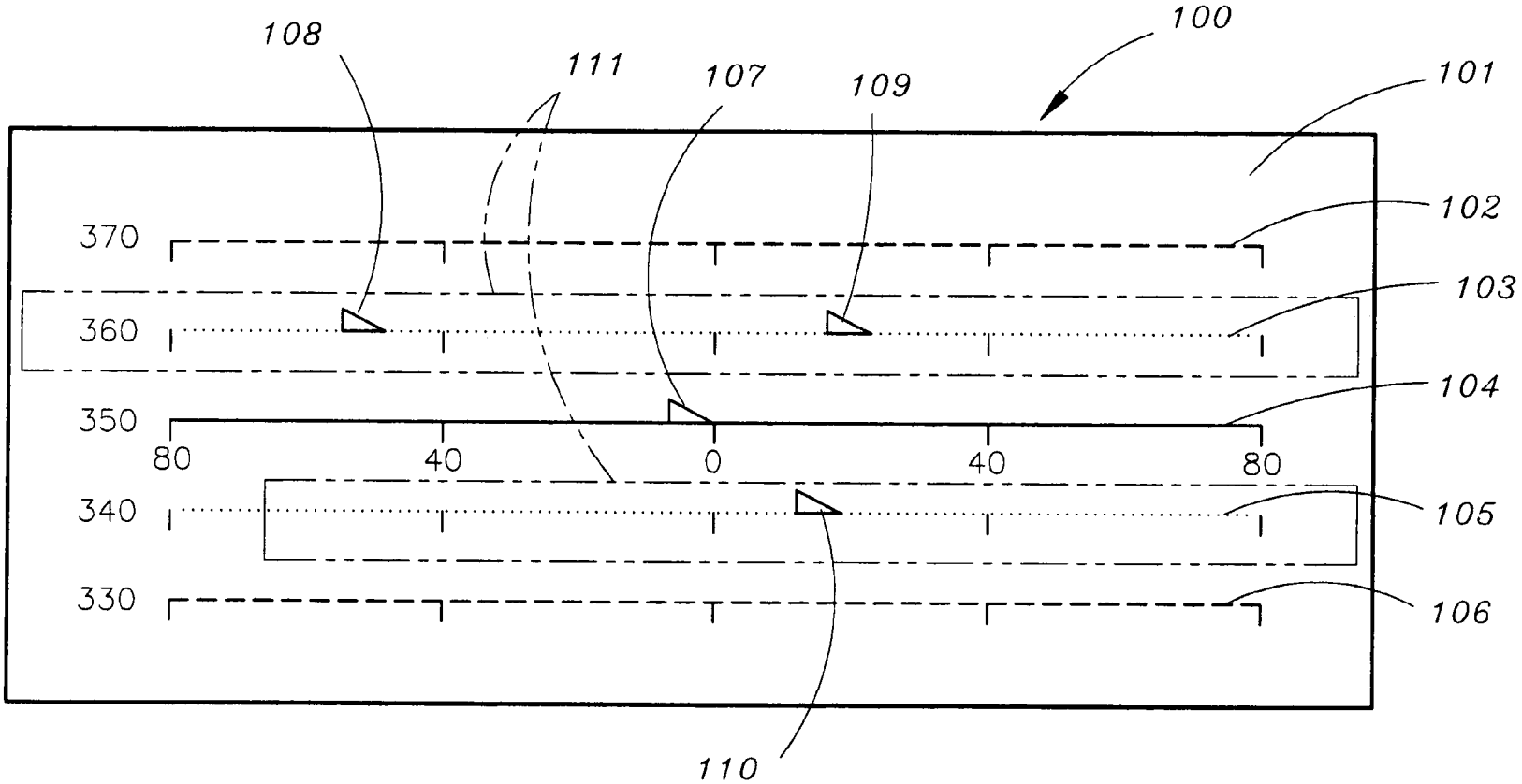
FIG. 1 is a block diagram illustrating a traffic display, in accordance with an exemplary embodiment of the present invention.

Referring generally to FIG. 1; a traffic display 100 for an aircraft, in accordance with an exemplary embodiment of the present invention, is illustrated. Traffic display 100 includes a vertical traffic indicator 101. Vertical traffic indicator 101 includes flight levels 102-106.

Traffic display 100 may receive the altitude of the aircraft and the altitudes of other aircraft within an area of the aircraft. Traffic display 100 may include a receiver for receiving the altitude of the aircraft and the altitudes of other aircraft within an area of the aircraft.

Flight levels 102-106 may represent various attitudes. A flight level is a standard nominal altitude for an aircraft. Flight levels may be assigned a number which is the nominal altitude in feet divided by a hundred. As illustrated, flight level 102 is assigned a number 370 and represents a nominal altitude of 37,000 feet. As illustrated, flight level 102 shows absolute altitude (height of the aircraft above terrain). Alternatively, flight level 102 may show relative altitude (the vertical separation between aircraft), such as +100 (which represents a relative altitude of +1000) or −200 (which represents a relative altitude of −2000). Vertical traffic indicator 101 may display other flight levels than flight levels 102-106 in order to represent other altitudes. Vertical traffic indicator 101 may display a different number of flight levels than illustrated with flight levels 102-106, for instance two flight levels or ten flight levels. As illustrated, flight levels 102-106 are depicted as patterned lines. A solid line may indicate the current flight level of the aircraft. A pink or purple line may also indicate the current flight level of the aircraft. A dotted line may indicate a flight level which is unavailable for the aircraft. A white line may also indicate a flight level which is unavailable for the aircraft. A dashed line may indicate a flight level which is available for the aircraft. A green line may indicate a flight level which is available for the aircraft. Other colors and other line patterns may be utilized to represent the current flight level of the aircraft, available flight levels for transit, and unavailable flight levels for transit without departing from the scope of the present invention. In alternative embodiments, flight levels 102-106 may be depicted utilizing other visual metaphors than patterned lines, for instance text, bars, or groupings of shapes.

Vertical traffic indicator 101 also includes aircraft indicators 107-110. Aircraft indicator 107 represents the aircraft. Aircraft indicators 108-110 represent other aircraft within an area of the aircraft represented by the vertical traffic indicator 101. Aircraft indicators 107-110 are positioned on the vertical traffic indicator 101 in relation to flight levels 102-106 to indicate the altitude of the aircraft represented by aircraft indicators 107-110. As illustrated, aircraft indicators 107-110 are depicted as triangles. In alternative embodiments, aircraft indicators 107-110 may be depicted utilizing other visual metaphors, for instance text, circles, squares, or other shapes.

Vertical traffic indicator 101 may also include separation standard (a standard utilized to maintain proper spacing between aircraft) indicators 111. Separation standard indicators 111 indicate the separation standards for other aircraft within an area of the aircraft represented by the vertical traffic indicator 101. Separation standard indicators 111 represent the area in the front and aft of an aircraft which should not be violated by another aircraft. As illustrated, separation standard indicators 111 are depicted as boxes. In alternative embodiments, separation standard indicators 111 may be depicted utilizing colors and/or other visual metaphors, for instance text, lines, or shapes.

Figure 2:
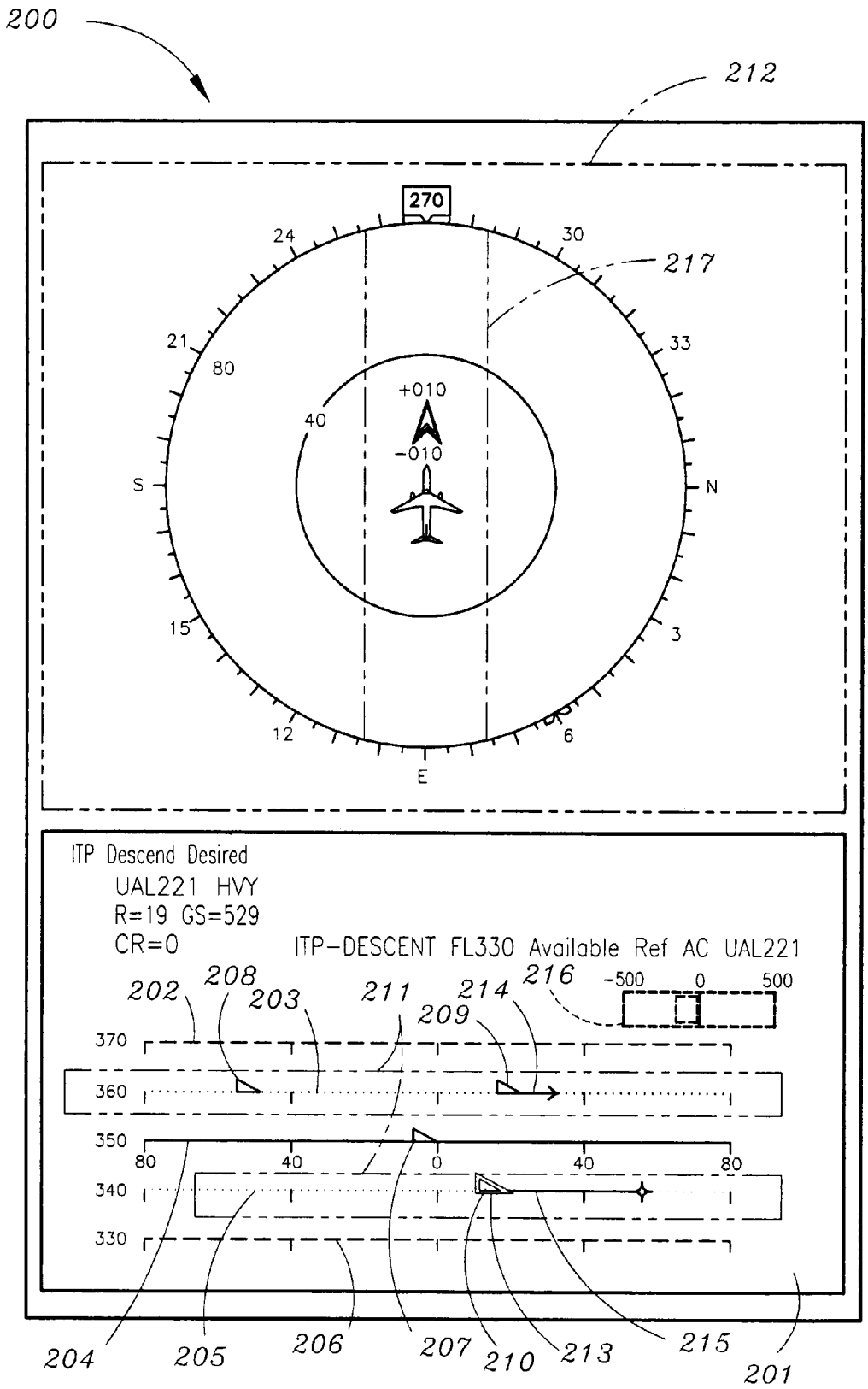
FIG. 2 is a block diagram illustrating a traffic display, in accordance with an alternative embodiment of the present invention.

Referring generally to FIG. 2; a traffic display 200 for an aircraft, in accordance with an alternative embodiment of the present invention, is illustrated. Traffic display 200 includes a vertical traffic indicator 201. Traffic display 200 may include a horizontal traffic indicator 212. Horizontal traffic indicator 212 may display an indicator 217 indicating the area represented by vertical traffic indicator 201.

Traffic display 200 may receive the altitude of the aircraft, the altitudes of other aircraft within an area of the aircraft, the speed of a reference aircraft for an ITP, and status information of other aircraft within an area of the aircraft. Traffic display 200 may include a receiver for receiving the altitude of the aircraft, the altitudes of other aircraft within an area of the aircraft, the speed of the aircraft and the speed of a reference aircraft for an ITP, and status information of other aircraft within an area of the aircraft.

Vertical traffic indicator 201 includes flight levels 202-206. Flight levels 202-206 may represent various altitudes. A flight level is a standard nominal attitude for an aircraft. Flight levels may be assigned a number which is the nominal altitude in feet divided by a hundred. As illustrated, flight level 202 is assigned a number 370 and represents a nominal altitude of 37,000 feet. As illustrated, flight level 102 shows absolute altitude (height of the aircraft above terrain). Alternatively, flight level 102 may show relative altitude (the vertical separation between aircraft), such as +100 (which represents a relative altitude of +1000) or −200 (which represents a relative altitude of −2000). Vertical traffic indicator 201 may display other flight levels than flight levels 202-206 in order to represent other altitudes. Vertical traffic indicator 201 may display a different number of flight levels than illustrated with flight levels 202-206, for instance two flight levels or ten flight levels. As illustrated, flight levels 202-206 are depicted as patterned lines. A solid line may indicate the current flight level of the aircraft. A pink or purple line may also indicate the current flight level of the aircraft. A dotted line may indicate a flight level which is unavailable for the aircraft. A white line may also indicate a flight level which is unavailable for the aircraft. A dashed line may indicate a flight level which is available for the aircraft. A green line may indicate a flight level which is available for the aircraft. Other colors and other line patterns may be utilized to represent the current flight level of the aircraft, available flight levels for transit, and unavailable flight levels for transit without departing from the scope of the present invention. In alternative embodiments, flight levels 202-206 may be depicted utilizing other visual metaphors than patterned lines, for instance text, bars, or groupings of shapes.

Vertical traffic indicator 201 also includes aircraft indicators 207-210. Aircraft indicator 207 represents the aircraft. Aircraft indicators 208-210 represent other aircraft within an area of the aircraft represented by the vertical traffic indicator 201. Aircraft indicators 207-210 are positioned on the vertical traffic indicator 101 in relation to flight levels 202-206 to indicate the altitude of the aircraft represented by aircraft indicators 207-210. As illustrated, aircraft indicators 207-210 are depicted as triangles. In alternative embodiments, aircraft indicators 207-210 may be depicted utilizing other visual metaphors, for instance text, circles, squares, or other shapes.

Aircraft indicators 208-210 include status indicators 214 and 215. Status indicators 214 and 215 show any status information that has been received about other aircraft in the area of the aircraft, such as intent or vertical trend. Vertical trend may be ascending, descending, or maintaining. Intent is the intended future action of the aircraft, such as the intent to proceed to a flight plan waypoint. A flight plan waypoint is a point of reference useful for navigation. As illustrated, status indicators 214 and 215 depict vertical trend with arrowed lines. Status indicator 214 depicts a forward pointing arrowed line, indicating that a vertical trend of maintain has been received for the other aircraft represented by aircraft indicator 209. Status indicator 215 depicts a line ending in a point, indicating that a vertical trend of maintain and an intent to proceed to a waypoint has been received for the other aircraft represented by aircraft indicator 210. Aircraft indicator 208 does not depict a status indicator, indicating that status information has not been received for the other aircraft represented by aircraft indicator 208. In alternative embodiments, status indicators 214 and 215 may be depicted utilizing other visual metaphors, such as shapes or text.

Aircraft indicator 210 includes reference aircraft indicator 213. Reference aircraft indicator 213 indicates that the other aircraft represented by aircraft indicator 210 is a reference aircraft for an ITP that the aircraft intends to perform. As illustrated, reference aircraft indicator 213 is depicted as a green box around aircraft indicator 210. In alternative embodiments, reference aircraft indicator 213 may be depicted utilizing other visual metaphors, such as colors, shapes, or text.

Traffic display 200 may also include a closing speed indicator 216. Closing speed indicator 216 displays information concerning the closing speed between the aircraft and another aircraft in the area of the aircraft which has been selected as a reference aircraft for an ITP. As illustrated, closing speed indicator 216 is depicted as a meter displaying the closing speed. In alternative embodiments, closing speed indicator 216 may depict closing speed utilizing other visual metaphors, such as text.

Figure 3:
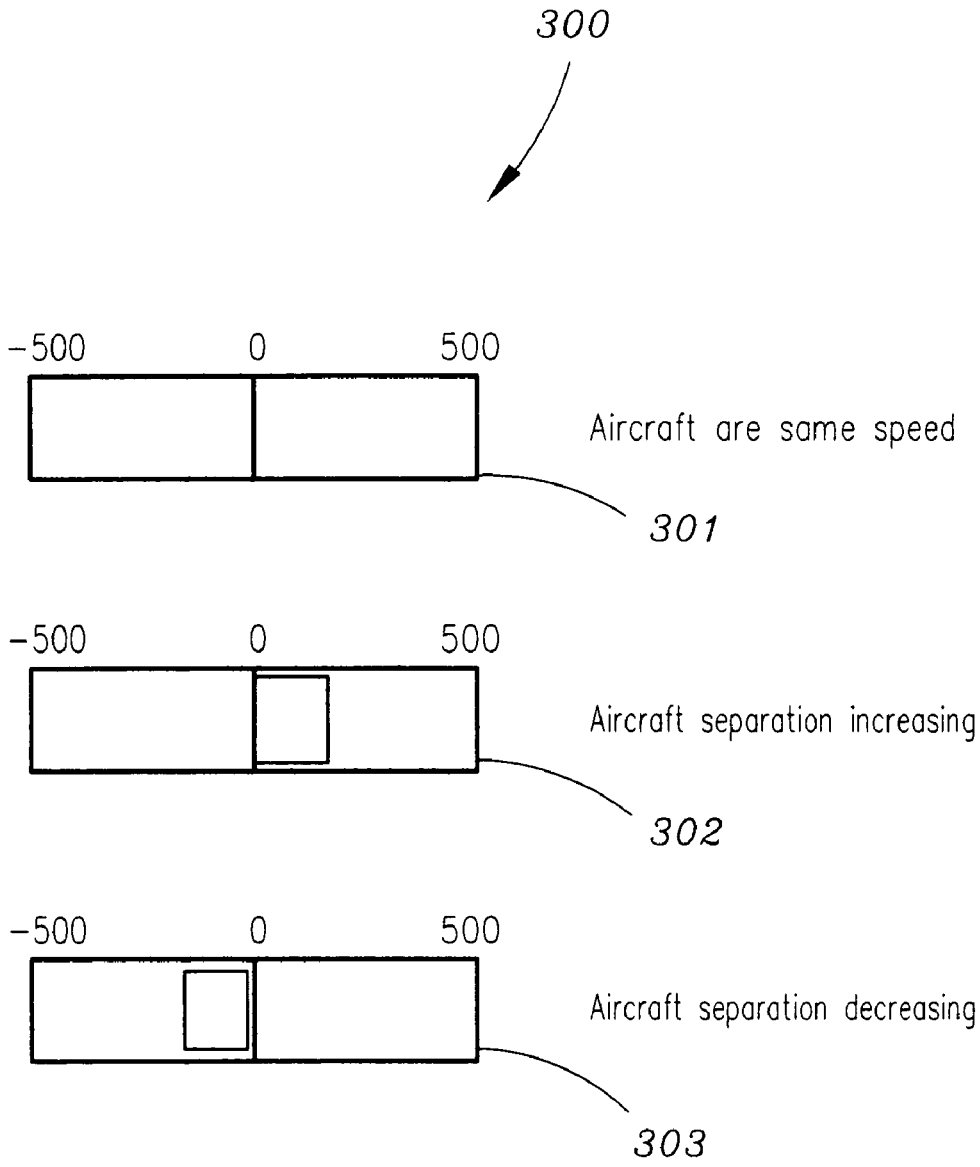
FIG. 3 is a block diagram illustrating a closing speed indicator for a traffic display, in accordance with an exemplary embodiment of the present invention.

Referring now to FIG. 3, the meter depicted on closing speed indicator 216 may be displayed in a first state 301 when the aircraft and the reference aircraft are traveling at the same speed. The meter depicted on closing speed indicator 216 may be displayed in a second state 302 when the separation between the aircraft and the reference aircraft is increasing. The meter depicted on the closing speed indicator 216 may be displayed in a third state 303 when the separation between the aircraft and the reference aircraft is decreasing.

Referring again to FIG. 2, vertical traffic indicator 201 may also include separation standard (a standard utilized to maintain proper spacing between aircraft) indicators 211. Separation standard indicators 211 indicate the separation standards for other aircraft within an area of the aircraft represented by the vertical traffic indicator 201. Separation standard indicators 211 represent the area in the front and aft of an aircraft which should not be violated by another aircraft. As illustrated, separation standard indicators 211 are depicted as boxes. In alternative embodiments, separation standard indicators 211 may be depicted utilizing colors and/or other visual metaphors, for instance text, lines, or shapes.

Figure 4:
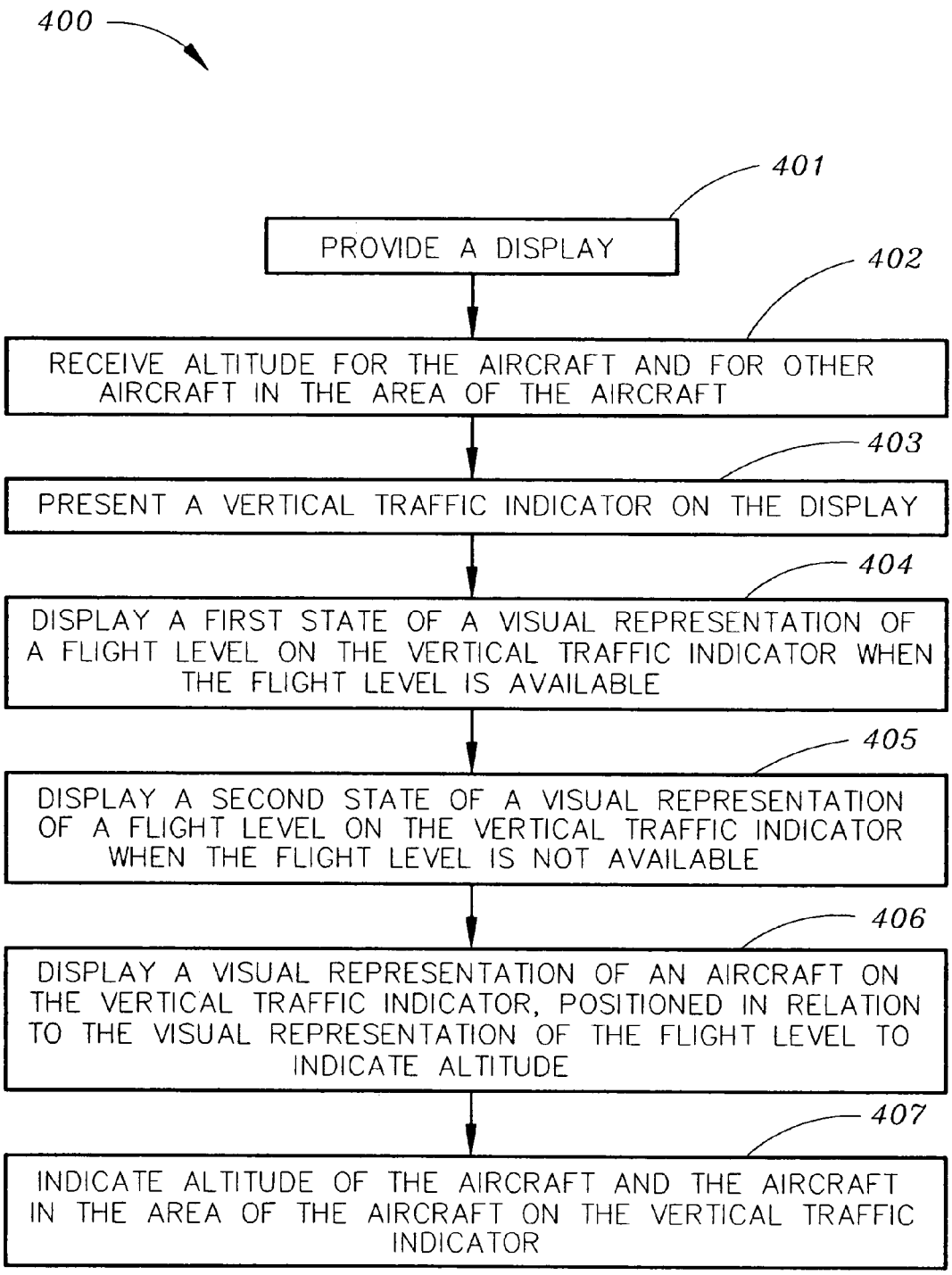
FIG. 4 is a flow chart illustrating a method of providing a traffic display, in accordance with an exemplary embodiment of the present invention.

Referring now to FIG. 4, a method 400 of providing a traffic display for an aircraft, in accordance with an exemplary embodiment of the present invention, is shown. In step 401, a display is provided. In step 402, altitude is received for the aircraft and for other aircraft in an area of the aircraft. In step 403, a vertical traffic indicator is displayed on the display. In step 404, a first state of a visual representation of a flight level is displayed on the vertical traffic indicator when the flight level is available. In step 405, a second state of a visual representation of a flight level is displayed on the vertical traffic indicator when the flight level is not available. The states of the visual representation of a flight level may comprise a first and second line pattern, a first and second color, or other visual metaphors. In step 406, a visual representation of an aircraft is displayed on the vertical traffic indicator, positioned in relation to the visual representation of the flight level to indicate altitude. The visual representation of an aircraft may comprise a triangle, a dot, or other visual metaphors. The visual representation of an aircraft may include a box or other visual metaphor indicating separation standards for the aircraft represented by the visual representation of an aircraft. The visual representation of an aircraft may include a box, colored line, or other visual metaphor indicating the aircraft represented by the representation of an aircraft is a reference aircraft for an ITP. In step 407, altitude of the aircraft and the other aircraft in the area of the aircraft are indicated on the vertical traffic indicator.

Figure 5:
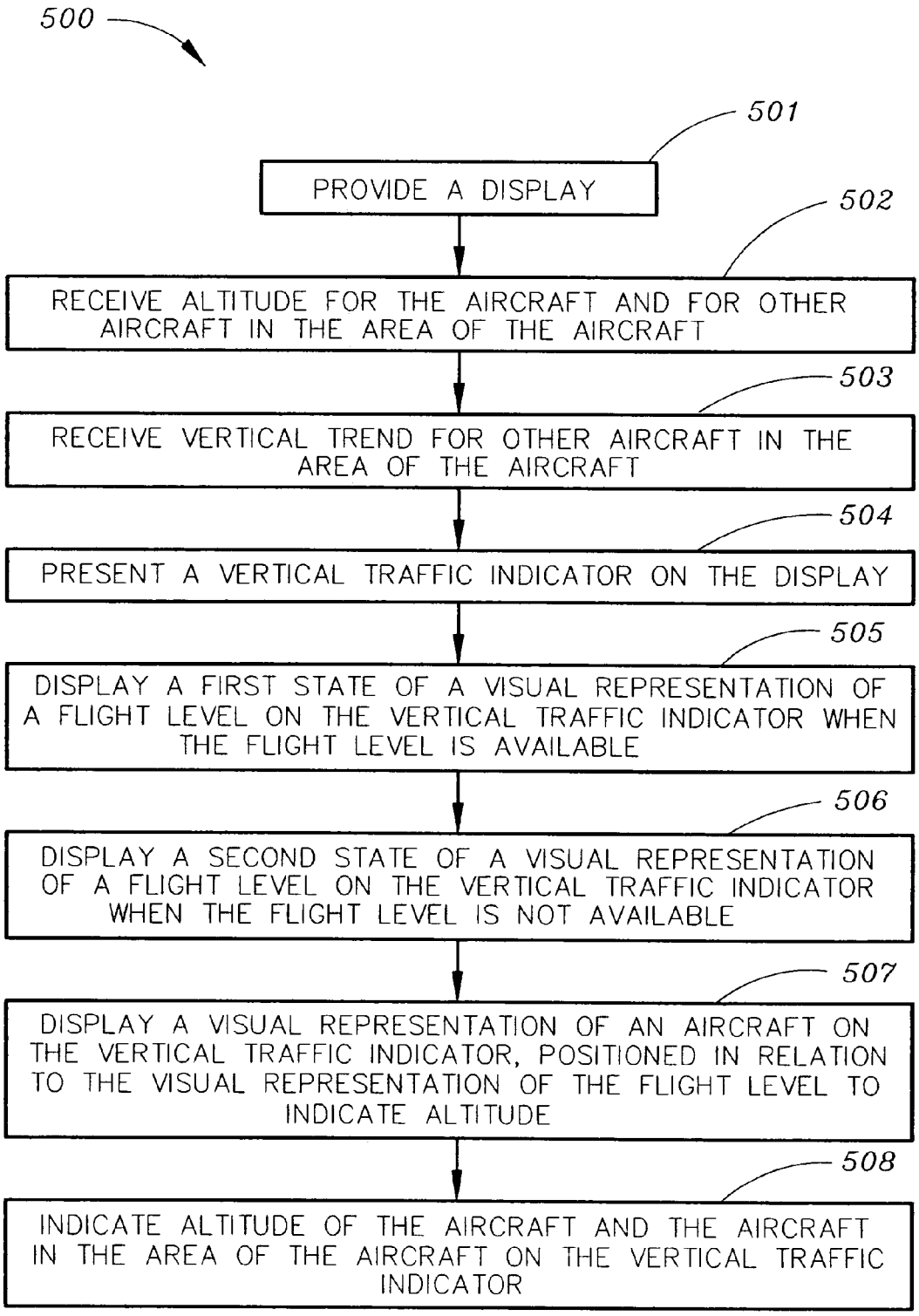
FIG. 5 is a flow chart illustrating a method of providing a traffic display, in accordance with an alternative embodiment of the present invention.

Referring now to FIG. 5, a method 500 of providing a traffic display for an aircraft, in accordance with an exemplary embodiment of the present invention, is shown. In step 501, a display is provided. In step 502, altitude is received for the aircraft and for other aircraft in an area of the aircraft. In step 503, vertical trend is received for other aircraft in the area of the aircraft. In step 504, a vertical traffic indicator is displayed on the display. In step 505, a first state of a visual representation of a flight level is displayed on the vertical traffic indicator when the flight level is available. In step 506, a second state of a visual representation of a flight level is displayed on the vertical traffic indicator when the flight level is not available. The states of the visual representation of a flight level may comprise a first and second line pattern, a first and second color, or other visual metaphors. In step 507, a visual representation of an aircraft is displayed on the vertical traffic indicator, positioned in relation to the visual representation of the flight level to indicate altitude. The visual representation of an aircraft may comprise a triangle, a dot, or other visual metaphors. The visual representation of an aircraft may include a box or other visual metaphor indicating separation standards for the aircraft represented by the visual representation of an aircraft. The visual representation of an aircraft may include an arrowed line or other visual metaphor indicating vertical trend for the aircraft represented by the visual representation of an aircraft. The visual representation of an aircraft may include a box, colored line, or other visual metaphor indicating the aircraft represented by the representation of an aircraft is a reference aircraft for an ITP. In step 508, attitude of the aircraft and the other aircraft in the area of the aircraft are indicated on the vertical traffic indicator.

Figure 6:
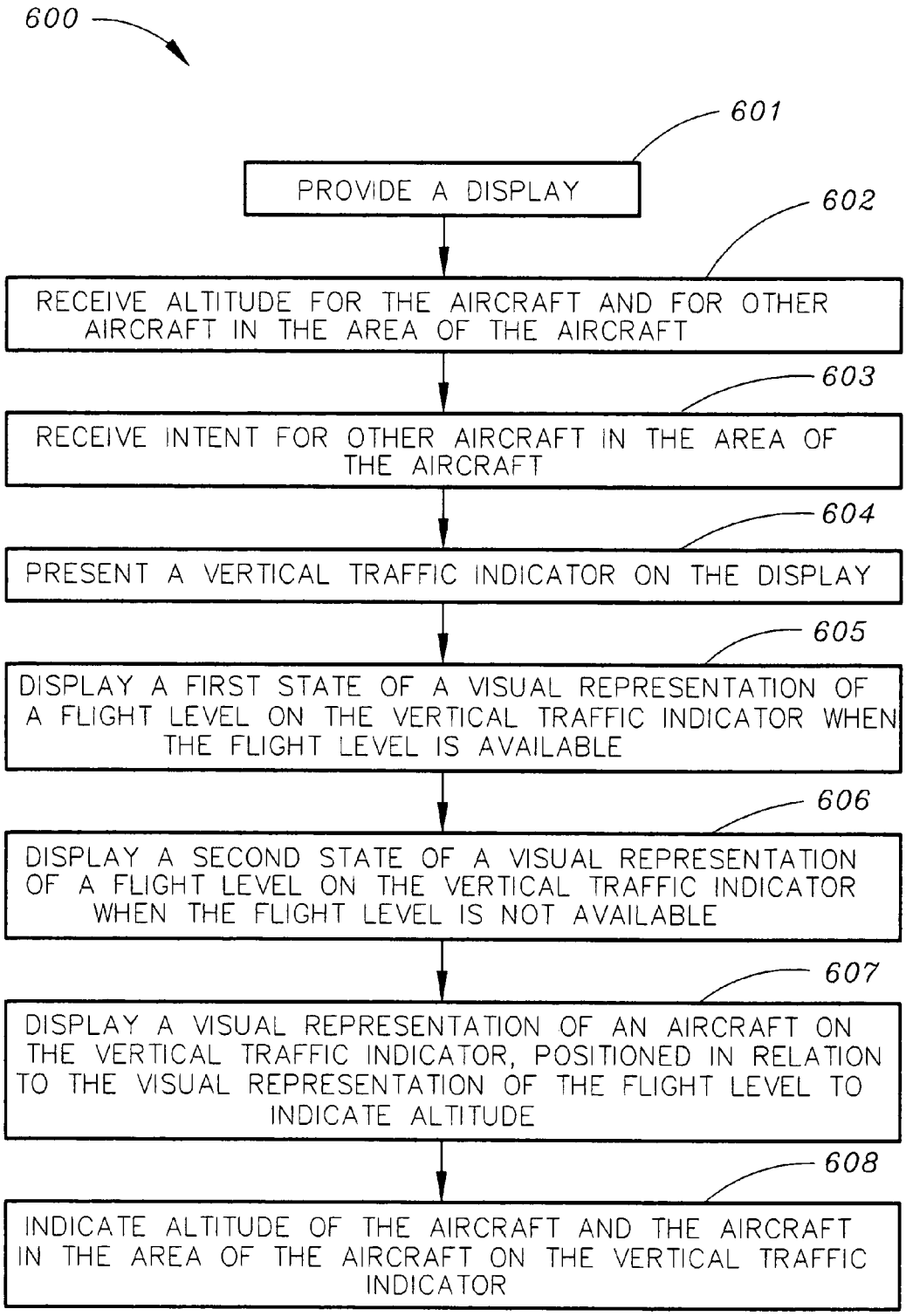
FIG. 6 is a flow chart illustrating a method of providing a traffic display, in accordance with an alternative embodiment of the present invention.

Referring now to FIG. 6, a method 600 of providing a traffic display for an aircraft, in accordance with an exemplary embodiment of the present invention, is shown. In step 601, a display is provided. In step 602, altitude is received for the aircraft and for other aircraft in an area of the aircraft. In step 603, intent is received for other aircraft in the area of the aircraft. In step 604, a vertical traffic indicator is displayed on the display. In step 605, a first state of a visual representation of a flight level is displayed on the vertical traffic indicator when the flight level is available. In step 606, a second state of a visual representation of a flight level is displayed on the vertical traffic indicator when the flight levet is not available. The states of the visual representation of a flight level may comprise a first and second line pattern, a first and second color, or other visual metaphors. In step 607, a visual representation of an aircraft is displayed on the vertical traffic indicator, positioned in relation to the visual representation of the flight level to indicate altitude. The visual representation of an aircraft may comprise a triangle, a dot, or other visual metaphors. The visual representation of an aircraft may include a box or other visual metaphor indicating separation standards for the aircraft represented by the visual representation of an aircraft. The visual representation of an aircraft may include an arrowed line or other visual metaphor indicating intent for the aircraft represented by the visual representation of an aircraft. The visual representation of an aircraft may include a box, colored line, or other visual metaphor indicating the aircraft represented by the representation of an aircraft is a reference aircraft for an ITP. In step 608, altitude of the aircraft and the other aircraft in the area of the aircraft are indicated on the vertical traffic indicator.

Figure 7:
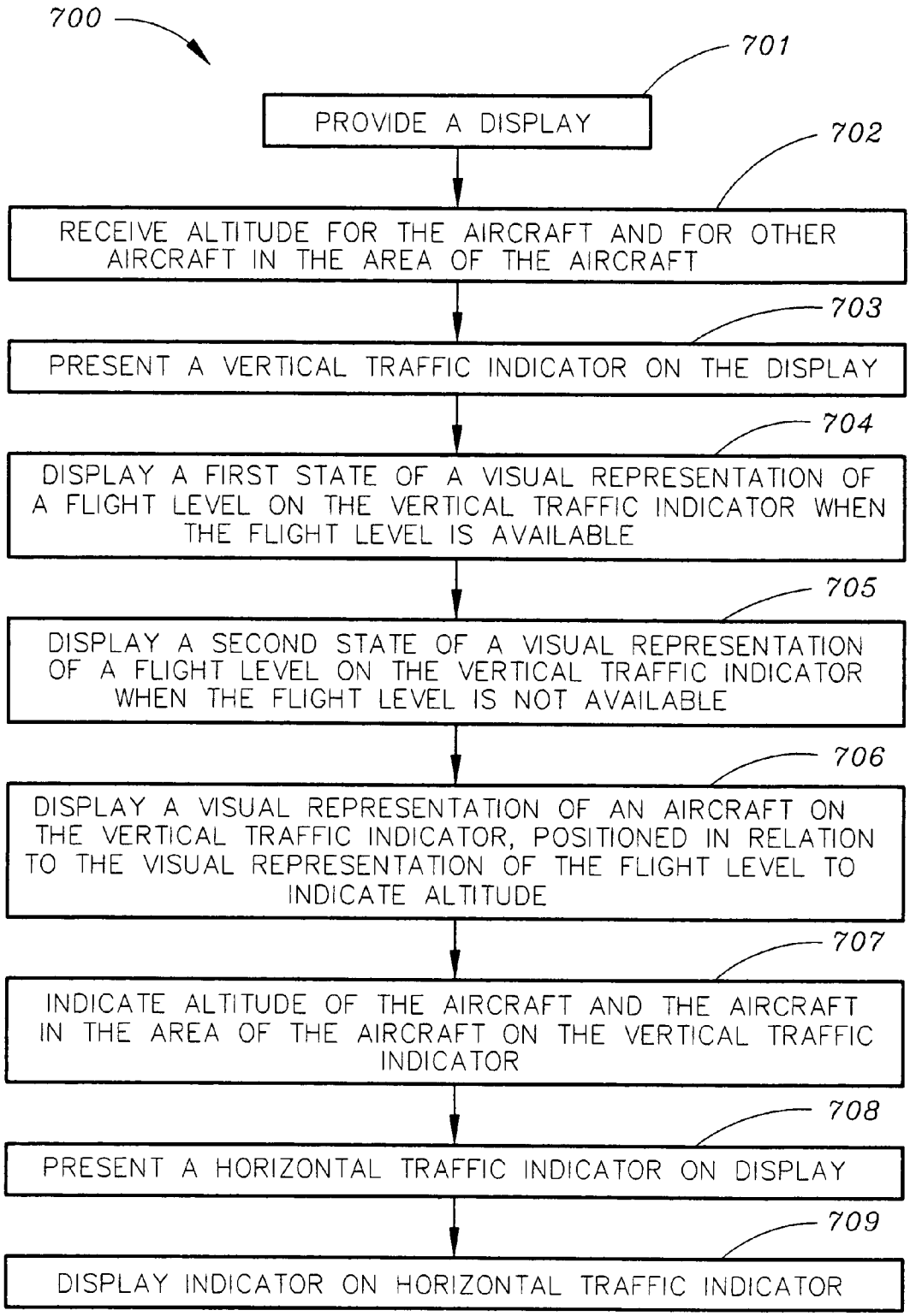
FIG. 7 is a flow chart illustrating a method of providing a traffic display, in accordance with an alternative embodiment of the present invention.

Referring now to FIG. 7, a method 700 of providing a traffic display for an aircraft, in accordance with an exemplary embodiment of the present invention, is shown. In step 701, a display is provided. In step 702, altitude is received for the aircraft and for other aircraft in an area of the aircraft. In step 703, a vertical traffic indicator is displayed on the display. In step 704, a first state of a visual representation of a flight level is displayed on the vertical traffic indicator when the flight level is available. In step 705, a second state of a visual representation of a flight level is displayed on the vertical traffic indicator when the flight level is not available. The states of the visual representation of a flight level may comprise a first and second line pattern, a first and second color, or other visual metaphors. In step 706, a visual representation of an aircraft is displayed on the vertical traffic indicator, positioned in relation to the visual representation of the flight level to indicate altitude. The visual representation of an aircraft may comprise a triangle, a dot, or other visual metaphors. The visual representation of an aircraft may include a box or other visual metaphor indicating separation standards for the aircraft represented by the visual representation of an aircraft. The visual representation of an aircraft may include a box, colored line, or other visual metaphor indicating the aircraft represented by the representation of an aircraft is a reference aircraft for an ITP. In step 707, altitude of the aircraft and the other aircraft in the area of the aircraft are indicated on the vertical traffic indicator. In step 708, a horizontal traffic indicator is displayed on the display. In step 709, an indicator is displayed on the horizontal traffic indicator, indicating the area represented by the vertical traffic indicator. The indicator may comprise a box or a colored region or other visual metaphor.

Figure 8:
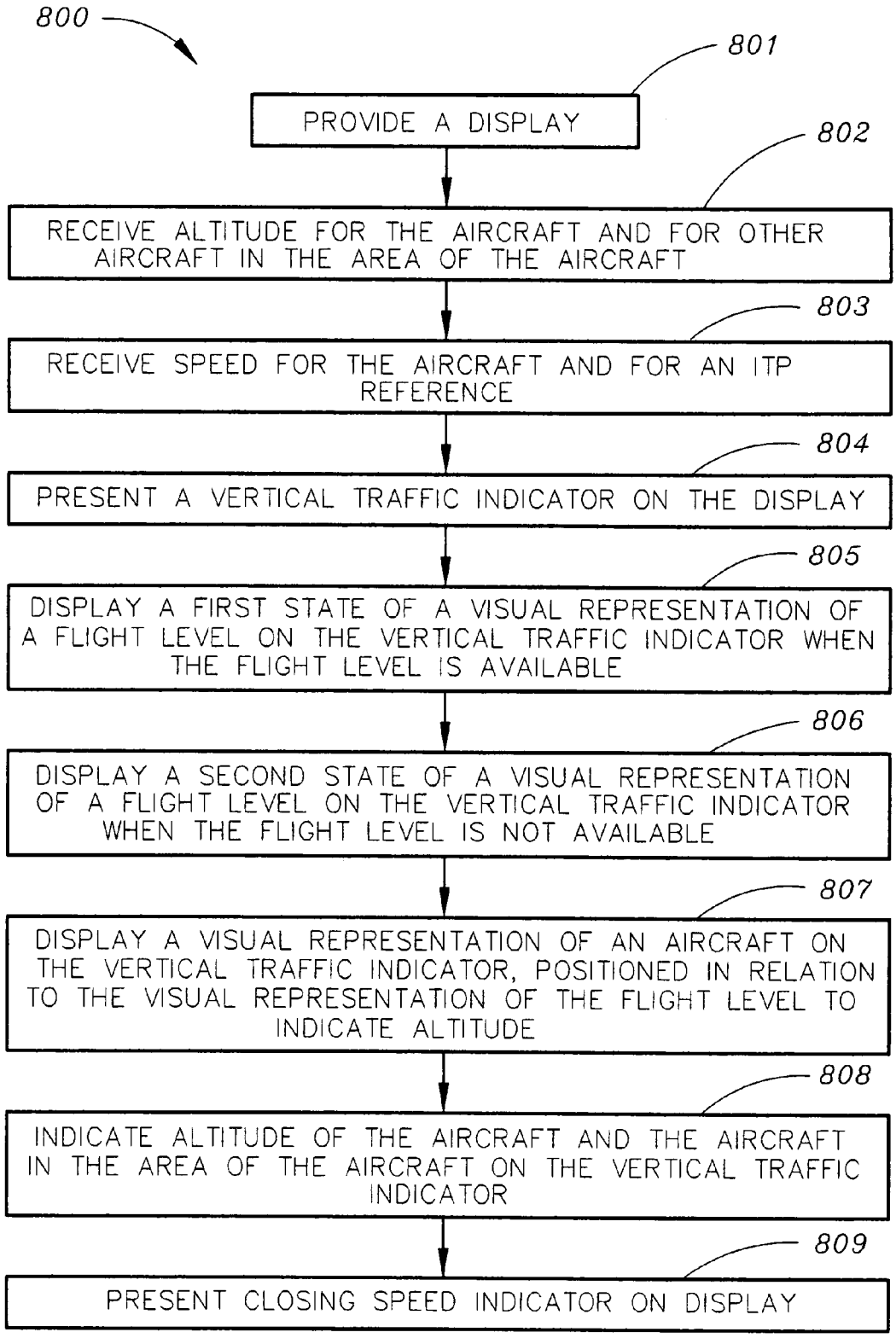
FIG. 8 is a flow chart illustrating a method of providing a traffic display, in accordance with an alternative embodiment of the present invention.

Referring now to FIG. 8, a method 800 of providing a traffic display for an aircraft, in accordance with an exemplary embodiment of the present invention, is shown. In step 801, a display is provided. In step 802, altitude is received for the aircraft and for other aircraft in an area of the aircraft. In step 803, speed is received for the aircraft and a reference aircraft for an ITP. In step 804, a vertical traffic indicator is displayed on the display. In step 805, a first state of a visual representation of a flight level is displayed on the vertical traffic indicator when the flight level is available. In step 806, a second state of a visual representation of a flight level is displayed on the vertical traffic indicator when the flight level is not available. The states of the visual representation of a flight level may comprise a first and second line pattern, a first and second color, or other visual metaphors. In step 807, a visual representation of an aircraft is displayed on the vertical traffic indicator, positioned in relation to the visual representation of the flight level to indicate altitude. The visual representation of an aircraft may comprise a triangle, a dot, or other visual metaphors. The visual representation of an aircraft may include a box or other visual metaphor indicating separation standards for the aircraft represented by the visual representation of an aircraft. The visual representation of an aircraft may include a box, colored line, or other visual metaphor indicating the aircraft represented by the representation of an aircraft is a reference aircraft for an ITP. In step 808, altitude of the aircraft and the other aircraft in the area of the aircraft are indicated on the vertical traffic indicator. In step 809, a closing speed indicator is presented on the display. The closing speed indicator may be depicted as a meter, text, or other visual metaphor illustrating the closing speed between the aircraft and a reference aircraft for an ITP.

Figure 9:
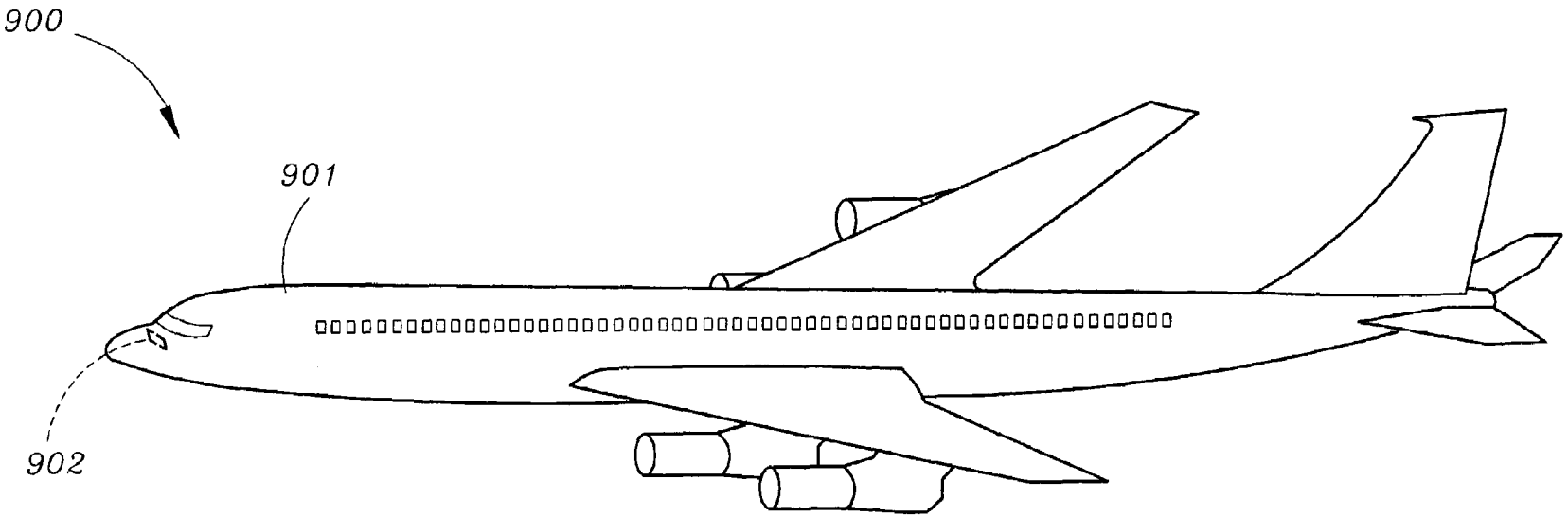
FIG. 9 is a block diagram a system for providing a traffic display, in accordance with an alternative embodiment of the present invention.

Referring now to FIG. 9, a system 900 for providing a traffic display, in accordance with an alternative embodiment of the present invention, is shown. System 900 for displaying traffic includes an aircraft 901 and a traffic display 902. Traffic display 902 receives altitude for the aircraft and for other aircraft within an area of the aircraft. Traffic display 902 also receives speed for the aircraft and for a reference aircraft for an ITP. Traffic display 902 may include a receiver for receiving the altitude of the aircraft, the altitudes of other aircraft within an area of the aircraft, the speed of the aircraft, and the speed of a reference aircraft for an ITP. Traffic display 902 presents a vertical traffic indicator depicting flight levels, the aircraft and other aircraft in an area around the aircraft (positioned in relation to the flight levels to indicate altitude), and separation standards for other aircraft around the aircraft. The flight levels are depicted in a first visual pattern and color when they are available for the aircraft and a second visual pattern and color when they are not available. The visual pattern and color of the visual representation of a flight level may comprise a first and second line pattern or other visual metaphors. The separation standards may be indicated by a box or other visual metaphor. The aircraft may be depicted as a triangle, a dot, or other visual metaphors. The other aircraft are depicted in a first state when they are not a reference aircraft for an ITP and in a second state when they are a reference aircraft for an ITP. The first state may comprise the basic depiction of the aircraft as a triangle, a dot, or other visual metaphor. The second state may include the basic depiction of the aircraft as a triangle, a dot, or other visual metaphor with the addition of a box, colored line, or other visual metaphor differentiating the second state from the first state. Traffic display 902 also presents a closing speed indicator depicting the closing speed between the aircraft and a reference aircraft for an ITP. The closing speed indicator may be depicted as a meter, text, or other visual metaphor illustrating the closing speed between the aircraft and a reference aircraft for an ITP.

The present invention provides a traffic display for visualizing the horizontal and vertical traffic separation for an ITP. The aircraft and other aircraft in the area of the aircraft are depicted, along with their respective flight levels. The flight levels which are available or are not available (for the aircraft to transit to) are immediately visually apparent from the traffic display. Thus, the pilot of the aircraft has clear and intuitive means of understanding the flying environment related to the performance of the ITP, increasing situational awareness and simplifying the ITP. The present invention is specifically advantageous for performance of an ITP, but may be integrated with displays including terrain, weather, flight plan waypoints, or TCAS (Traffic Collision Avoidance System) traffic without departing from the scope of the present invention.

It is understood that the present invention is not limited to any underlying implementing technology. The present invention may be implemented utilizing any combination of software and hardware technology. The present invention may be implemented using a variety of technologies without departing from the scope and spirit of the invention or without sacrificing all of its material advantages.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A traffic display, comprising:

a display, which receives a first altitude for a first aircraft and a second altitude for a second aircraft within an area around the first aircraft, the display including a vertical traffic indicator which is presented on the display, the vertical traffic indicator comprising:

a visual representation of at least one flight level having a first state and a second state;

a visual representation of at least one aircraft, positioned in relation to the visual representation of the at least one flight level to indicate an altitude for the at least one aircraft;

wherein the visual representation of the flight level is in the first state when the flight level is available for the first aircraft to transit to and the visual representation of the flight level is in the second state when the flight level is not available for the first aircraft to transit to;

wherein the vertical traffic indicator represents the area around the first aircraft, the first altitude for the first aircraft is indicated on the vertical traffic indicator, and the second altitude for the second aircraft is indicated on the vertical traffic indicator.

2. The traffic display as claimed in claim 1, wherein the first state of the visual representation of the flight level has a first visual pattern and the second state of the visual representation of the flight level has a second visual pattern.

3. The traffic display as claimed in claim 1, wherein the first state of the visual representation of the flight level has a first color and the second state of the visual representation of the flight level has a second color.

4. The traffic display as claimed in claim 1, wherein the visual representation of the at least one aircraft includes an indicator indicating a separation standard for the at least one aircraft.

5. The traffic display as claimed in claim 1, wherein the display receives a vertical trend for the second aircraft and the visual representation of the at least one aircraft includes an indicator indicating a vertical trend for the at least one aircraft.

6. The traffic display as claimed in claim 1, wherein the display receives an intent for the second aircraft and the visual representation of the at least one aircraft includes an indicator indicating an intent for the at least one aircraft.

7. The traffic display as claimed in claim 1, wherein the display includes a horizontal traffic indicator, which is presented on the display, comprising:

an indicator indicating a selected area of the horizontal traffic indicator;

wherein the selected area of the horizontal traffic indicator represents the area around the aircraft.

8. The traffic display as claimed in claim 1, wherein the visual representation of the at least one aircraft has a first state and a second state, the visual representation of the at, least one aircraft is in the first state when the at least one aircraft is not a reference aircraft for an in-trail procedure, and the visual representation of the at least one aircraft is in the second state when the at least one aircraft is a reference aircraft for an in-trail procedure.

9. The traffic display as claimed in claim 1, wherein the display receives a first speed of the first aircraft and a second speed of a reference aircraft for an in-trail procedure and the display further includes a closing speed indicator, which is presented on the display, which displays a closing speed of the first aircraft and the reference aircraft.

10. The traffic display as claimed in claim 9, wherein the closing speed indicator comprises a visual indicator with a first state, a second state, and a third state wherein the visual indicator is in the first state when the separation between the first aircraft and the reference aircraft is not changing, the visual indicator is in the second state when the separation between the first aircraft and the reference aircraft is increasing, and the visual indicator is in the third state when the separation between the first aircraft and the reference aircraft is decreasing.

11. A method of providing a traffic display, comprising the steps of:

providing a display;

receiving a first altitude for a first aircraft and a second altitude for a second aircraft within an area around the first aircraft;

presenting a vertical traffic indicator on the display, which represents the area around the first aircraft;

displaying a first state of a visual representation of at least one flight level on the vertical traffic indicator when the flight level is available for the first aircraft to transit to;

displaying a second state of the visual representation of the flight level in on the vertical traffic indicator when the flight level is not available for the first aircraft to transit to;

displaying a visual representation of at least one aircraft on the vertical traffic indicator, positioned in relation to the visual representation of the flight level to indicate an altitude for the at least one aircraft; and indicating the first attitude for the first aircraft and the second altitude for the second aircraft on the vertical traffic indicator.

12. The method of claim 11, wherein the first state of the visual representation of the flight level has a first visual pattern and the second state of the visual representation of the flight level has a second visual pattern.

13. The method of claim 11, wherein the first state of the visual representation of the flight level has a first color and the second state of the visual representation of the flight level has a second color.

14. The method of claim 11, wherein the visual representation of the at least one aircraft includes an indicator indicating a separation standard for the at least one aircraft.

15. The method of claim 11, wherein the visual representation of the at least one aircraft includes an indicator indicating a vertical trend for the at least one aircraft and further comprising the step of:

receiving a vertical trend for the second aircraft.

16. The method of claim 11, wherein the visual representation of the at least one aircraft includes an indicator indicating an intent for the at least one aircraft and further comprising the step of:

receiving an intent for the second aircraft.

17. The method of claim 11, further comprising the steps of:

presenting a horizontal traffic indicator on the display;

displaying an indicator on the horizontal traffic indicator indicating an area of the horizontal traffic indicator which represents the area around the first aircraft.

18. The method of claim 11, wherein the visual representation of the at least one aircraft has a first and a second state and the step of displaying a visual representation of at least one aircraft on the vertical traffic indicator further comprises the steps of:

displaying the first state of the visual representation of the at least one aircraft on the vertical traffic indicator when the at least one aircraft is not a reference aircraft for an in-trail procedure; and displaying the second state of the visual representation of the at least one aircraft on the vertical traffic indicator when the at least one aircraft is a reference for an in-trail procedure.

19. The method of claim 11, further comprising the steps of:

receiving a first speed for the first aircraft and a second speed for a reference aircraft for an in-trail procedure;

presenting a closing speed indicator on the display which displays a closing speed of the first aircraft and the reference aircraft.

20. The method of claim 19, wherein the closing speed indicator comprises a visual indicator and the step of presenting a closing speed indicator on the display which displays the closing speed of the first aircraft and the reference aircraft further comprises:

displaying a first state of the visual indicator when the separation between the first aircraft and the reference aircraft is not changing;

displaying a second state of the visual indicator when the separation between the first aircraft and the reference aircraft is increasing; and displaying a third state of the visual indicator when the separation between the first aircraft and the reference aircraft is decreasing.

21. A system for displaying traffic, comprising:

a first aircraft;

a display, which receives a first attitude for the first aircraft, a second attitude for a second aircraft within an area around the first aircraft, a first speed for the first aircraft, and a second speed for a reference aircraft for an in-trail procedure;

a closing speed indicator, which is presented on the display and displays a closing speed of the first aircraft and the reference aircraft; and a vertical traffic indicator, which is presented on the display, comprising;

a visual representation of at least one flight level having a first state and a second state, the first state having a first visual pattern and a first color, the second state having a second visual pattern and a second color;

a visual representation of at least one aircraft having a first state and a second state, positioned in relation to the visual representation of the at least one flight level to indicate an altitude for the at least one aircraft, including an indicator indicating a separation standard for the at least one aircraft;

wherein the visual representation of the flight level is in the first state when the flight level is available for the first aircraft to transit to, the visual representation of the flight level is in the second state when the flight level is not available for the first aircraft to transit to, the visual representation of the at least one aircraft is in the first state when the at least one aircraft is not a reference aircraft for an in-trail procedure, and the visual representation of the at least one aircraft is in the second state when the at least one aircraft is a reference aircraft for an in-trail procedure;

wherein the vertical traffic indicator represents the area around the first aircraft, the first altitude for the first aircraft is indicated on the vertical traffic indicator, and the second attitude for the second aircraft is indicated on the vertical traffic indicator.

* * * * *